US011274904B2

(12) United States Patent
Dwyer et al.

(10) Patent No.: US 11,274,904 B2
(45) Date of Patent: Mar. 15, 2022

(54) REMOTELY OPERABLE WEAPON MOUNT

(71) Applicant: AimLock Inc., Littleton, CO (US)

(72) Inventors: Benjamin Dwyer, Littleton, CO (US); Bryan Sterling Bockmon, Littleton, CO (US); Raymond Keeney, Littleton, CO (US); Jason R. Gallia, Littleton, CO (US); Shane Korthuis, Littleton, CO (US); Dusty Terry, Littleton, CO (US); Marc Hanchak, Littleton, CO (US)

(73) Assignee: AIMLOCK INC., Littleton, CO (US)

( * ) Notice: Subject to any disclaimer, the term of this patent is extended or adjusted under 35 U.S.C. 154(b) by 0 days.

(21) Appl. No.: 17/002,237

(22) Filed: Aug. 25, 2020

(65) Prior Publication Data

US 2021/0131766 A1 May 6, 2021

Related U.S. Application Data

(60) Provisional application No. 62/926,339, filed on Oct. 25, 2019.

(51) Int. Cl.

| | |
|---|---|
| ***F41G 3/16*** | (2006.01) |
| ***F41A 23/52*** | (2006.01) |
| ***F41A 23/06*** | (2006.01) |

(52) U.S. Cl.

CPC ..... *F41G 3/165* (2013.01); *F41A 23/06* (2013.01); *F41A 23/52* (2013.01)

(58) Field of Classification Search

CPC ..... F41G 3/165; F41A 23/06; F41A 23/52

USPC ..... 89/37.03, 39.07, 39.13, 40.01, 40.03, 89/41.05

See application file for complete search history.

(56) References Cited

U.S. PATENT DOCUMENTS

| | | | | |
|---|---|---|---|---|
| 2,014,762 | A * | 9/1935 | Fergus | F41A 27/06 89/37.02 |
| 2,405,792 | A * | 8/1946 | Lazarus, Jr. | F41F 1/08 89/37.03 |
| 2,582,225 | A * | 1/1952 | Bowser | F41A 17/08 89/134 |
| 3,618,456 | A | 11/1971 | Mindel | |
| 4,280,394 | A * | 7/1981 | Singenberger | B63G 1/00 89/37.02 |
| 5,456,157 | A * | 10/1995 | Lougheed | F41A 17/08 348/143 |

(Continued)

FOREIGN PATENT DOCUMENTS

| | | |
|---|---|---|
| CN | 204440222 U | 7/2015 |
| CN | 204514177 U | 7/2015 |

(Continued)

*Primary Examiner* — Bret Hayes

(74) *Attorney, Agent, or Firm* — Kilpatrick Townsend & Stockton LLP

(57) ABSTRACT

A weapon mount for controlling targeting of a weapon includes a base, an arm that extends from the base, and an attachment component that is rotatably coupled with the arm. The base is attachable to a platform and is rotatable to control a yaw of the weapon relative to the platform. The attachment component is configured to couple with the weapon and is rotatable to control a pitch of the weapon relative to the platform. The arm is positioned relative to the base so that a recoil vector of the weapon is within 0.5 inches radially of an axis of rotation of the base.

20 Claims, 7 Drawing Sheets

(56) References Cited

U.S. PATENT DOCUMENTS

| | | | | |
|---|---|---|---|---|
| 5,822,713 | A * | 10/1998 | Profeta | F41G 3/02 701/302 |
| 5,834,677 | A | 11/1998 | Muller | |
| 5,974,940 | A | 11/1999 | Madni | |
| 6,269,730 | B1 | 8/2001 | Hawkes | |
| 6,885,332 | B2 | 4/2005 | Panek et al. | |
| 7,047,863 | B2 | 5/2006 | Hawkes et al. | |
| 7,147,062 | B2 | 12/2006 | Kolacz et al. | |
| 7,210,392 | B2 | 5/2007 | Greene | |
| 7,469,623 | B1 | 12/2008 | Olcott | |
| 7,963,205 | B1 * | 6/2011 | Brooks | F41A 27/14 89/37.03 |
| 8,109,191 | B1 | 2/2012 | Rudakevych et al. | |
| 8,234,968 | B2 | 8/2012 | Hodge | |
| 8,336,442 | B2 | 12/2012 | Testa et al. | |
| 8,448,561 | B2 | 5/2013 | Carroll et al. | |
| 8,601,736 | B2 | 12/2013 | Andersson | |
| 8,683,909 | B1 | 4/2014 | Copus | |
| 9,033,232 | B2 | 5/2015 | Bockman | |
| 9,062,927 | B1 | 6/2015 | Tepaske | |
| 9,151,573 | B2 | 10/2015 | Isola et al. | |
| 9,435,603 | B2 | 9/2016 | Choi | |
| 9,464,856 | B2 | 10/2016 | Lung et al. | |
| 9,612,088 | B2 | 4/2017 | Theriault | |
| 9,784,529 | B1 | 10/2017 | Angle | |
| D898,859 | S | 10/2020 | Dwyer et al. | |
| 2005/0066807 | A1 * | 3/2005 | Persson | F41G 3/165 89/41.01 |
| 2007/0261544 | A1 * | 11/2007 | Philippe | F41A 23/24 89/41.05 |
| 2008/0148931 | A1 | 6/2008 | Svensson et al. | |
| 2010/0083817 | A1 | 4/2010 | Son et al. | |
| 2011/0030544 | A1 * | 2/2011 | Hodge | F41G 3/165 89/41.05 |
| 2011/0031312 | A1 | 2/2011 | Laupstad et al. | |
| 2011/0296978 | A1 | 12/2011 | Hamish et al. | |
| 2012/0174741 | A1 | 7/2012 | Rogers | |
| 2014/0028856 | A1 | 1/2014 | Ehrlich | |
| 2014/0360072 | A1 | 12/2014 | Lupher | |
| 2015/0059567 | A1 * | 3/2015 | Fox | F41H 5/266 89/41.19 |
| 2015/0101229 | A1 | 4/2015 | Hall | |
| 2015/0211828 | A1 | 7/2015 | Lupher | |
| 2015/0226524 | A1 | 8/2015 | Batchvarov | |
| 2015/0345887 | A1 | 12/2015 | Shneorson | |
| 2016/0086346 | A1 | 3/2016 | Levilly | |
| 2016/0187094 | A1 | 6/2016 | Bockmon | |
| 2016/0258704 | A1 | 9/2016 | Hobson | |
| 2019/0137219 | A1 | 5/2019 | Bockmon et al. | |
| 2019/0145738 | A1 | 5/2019 | Chae | |
| 2019/0310042 | A1 | 10/2019 | Himmich | |

FOREIGN PATENT DOCUMENTS

| | | | |
|---|---|---|---|
| DE | 102015120205 | A1 | 3/2017 |
| ES | 1158783 | U | 6/2016 |
| WO | 2013/183047 | A1 | 12/2013 |

* cited by examiner

REMOTELY OPERABLE WEAPON MOUNT

CROSS-REFERENCE TO RELATED APPLICATIONS

This application claims priority to Provisional U.S. Patent Application No. 62/926,339 filed Oct. 25, 2019, entitled "Remotely Operable Weapon Mount," the entire disclosure of which is hereby incorporated by reference, for all purposes, as if fully set forth herein.

STATEMENT REGARDING FEDERALLY SPONSORED RESEARCH OR DEVELOPMENT

This invention was made with Government support under Contract No. W15QKN-14-9-1001, awarded by U.S. Department of Defense. The Government has certain rights in this invention.

BACKGROUND

The embodiments herein relate generally to weapon mounts and more specifically to weapon mounts that may be remotely operable to effect firing of an attached weapon or firearm.

Firearms are commonly used weapons in lethal and non-lethal situations. Lethal weapons are commonly used in combat to attack or neutralize enemy forces. Non-lethal weapons are commonly used to mitigate or control hostile or combative situations. In either instance, an operator of the weapon may confront dangerous and even life threatening situations. To minimize potential harm to an operator of the weapon, remotely operable weapons and firearms may be used. Such weapons and firearms may enable an operator to assess a situation and respond accordingly without placing the operator in overt danger. Precise targeting and control of such weapons is important to ensure that hostile or dangerous situations are quickly and effectively controlled.

SUMMARY

This invention relates generally to weapon mounts that are configured to control targeting or aiming of a lethal or non-lethal weapon. According to a first aspect, a remotely operable weapon mount that is configured for controlling targeting of an attached firearm includes a base that is attachable to a platform, a yoke arm that extends from the base, and an attachment component that is coupled with the yoke arm. The base is rotatable 360 degrees about the platform and the attachment component is configured for releasably attaching the firearm to the base. The attachment component is rotatable about an axis that is orthogonal to an axis of rotation of the base so the attached firearm is rotatable between 30 and 60 degrees relative to the yoke arm and base. The attachment component is configured to couple with an upper receiver of the firearm so that a lower receiver of the attached firearm is aligned roughly parallel with the base and the yoke arm is positioned relative to the base so that a recoil vector of the attached firearm is within 0.5 inches radially of the axis of rotation of the base.

A camera is typically coupled with the yoke arm on an opposite side of the yoke arm from the attached firearm. The camera is rotatable about an axis that is parallel to the axis of rotation of the attachment component and the camera is configured to rotate in sync with the attached firearm. The weapon mount commonly includes one or more processors that are operably coupled with a motor of the base and with a motor of the yoke arm. The one or more processors are also typically coupled with the camera in order to. The one or more processors effect one or more of the following operations: control of rotation of the base, control of rotation of the attachment component; control of one or more functions of the camera, and the like. The camera is commonly coupled with the yoke arm so that a center of viewpoint of the camera is aligned with a bore axis of the attached firearm and so that the camera and attached firearm rotate together in pitch. The camera may be coupled with the yoke arm via a spherical joint that enables adjustment of a position of the camera relative to the yoke arm and attached firearm.

The yoke arm may include double bearings that support an internal drive shaft that is attached to the attachment component. The yoke arm may include an integrated motor that controls a rotation of the attachment component. The attachment component may be coupleable with the firearm so that casings ejected from the attached firearm are ejected away from or toward the base. The weapon mount may include a single yoke arm or multiple yoke arms. The base may include a coiled electrical contact.

According to another aspect, a weapon mount that is configured for controlling targeting of a weapon includes a base that is rotatably attachable to a platform, an arm that extends from the base, and an attachment component that is rotatably coupled with the arm. The base is rotatable to control a yaw of the weapon relative to the platform and the attachment component is rotatable to control a pitch of the weapon relative to the platform. The attachment component is configured to couple with the weapon. The arm is positioned relative to the base so that a recoil vector of the weapon is within 0.5 inches radially of an axis of rotation of the base.

The attachment component is coupleable with an upper receiver of the weapon so that a lower receiver of the weapon extends outward and away from the arm. The weapon mount typically also includes a camera that is rotatably coupled with the arm on an opposite side of the arm from the weapon. The camera is configured to rotate in pitch with the weapon. The weapon mount also typically includes one or more processors that are operably coupled with one or more motors of the weapon mount and with the camera. The one or more processors effect one or more of the following operations: control of the yaw of the weapon via rotation of the base, control of the pitch of the weapon via rotation of the attachment component, control of one or more functions of the camera, and the like. The camera may be coupled with the arm via a spherical joint that enables adjustment of a position of the camera relative to the arm and relative to the weapon. The arm may include double bearings that support an internal drive shaft that is coupled with the attachment component and with the camera. The weapon mount may include a single arm or multiple arms.

According to another aspect, a method of attaching a weapon to a weapon mount includes providing a weapon mount and attaching the weapon to the weapon mount. The weapon mount may include a base that is rotatably attachable to a platform, an arm that extends from the base, and an attachment component that is rotatably coupled with the arm. The base may be rotatable to control a yaw of the weapon relative to the platform and the attachment component may be rotatable to control a pitch of the weapon relative to the platform. The attachment component is configured to couple with the weapon. The may be positioned relative to the base so that a recoil vector of the weapon is within 0.5 inches radially of an axis of rotation of the base.

Attaching the weapon to the weapon mount may include attaching an upper receiver of the weapon to the weapon mount so that a lower receiver of the weapon extends outward and away from the arm of the weapon mount. The method may also include attaching a camera to the weapon mount.

According to another aspect, a method of remotely firing a weapon includes providing a weapon that is attached to a weapon mount, receiving an input corresponding to an instruction or command to fire the weapon, and causing firing of the weapon based on the input received. The weapon mount may include a base that is rotatably attachable to a platform, an arm that extends from the base, and an attachment component that is rotatably coupled with the arm and that is configured to couple with the weapon. The base may be rotatable to control a yaw of the weapon relative to the platform and the attachment component may be rotatable to control a pitch of the weapon relative to the platform. The arm may be positioned relative to the base so that a recoil vector of the weapon is within 0.5 inches radially of an axis of rotation of the base. The weapon mount may also include one or more processors and one or more communication components. The input corresponding to an instruction or command to fire the weapon may be received via the one or more communication components and firing of the weapon based on the input received may be cause, effected, or actuated via the one or more processors.

The one or more communication components may be a wireless interface or component that is configured to receive and transmit information wirelessly. The weapon mount may be attached to a watercraft, a land vehicle, an armored vehicle, an aircraft, an unmanned aerial vehicle, and the like.

BRIEF DESCRIPTION OF THE DRAWINGS

The present technology is described in conjunction with the appended figures.

Figure 1:
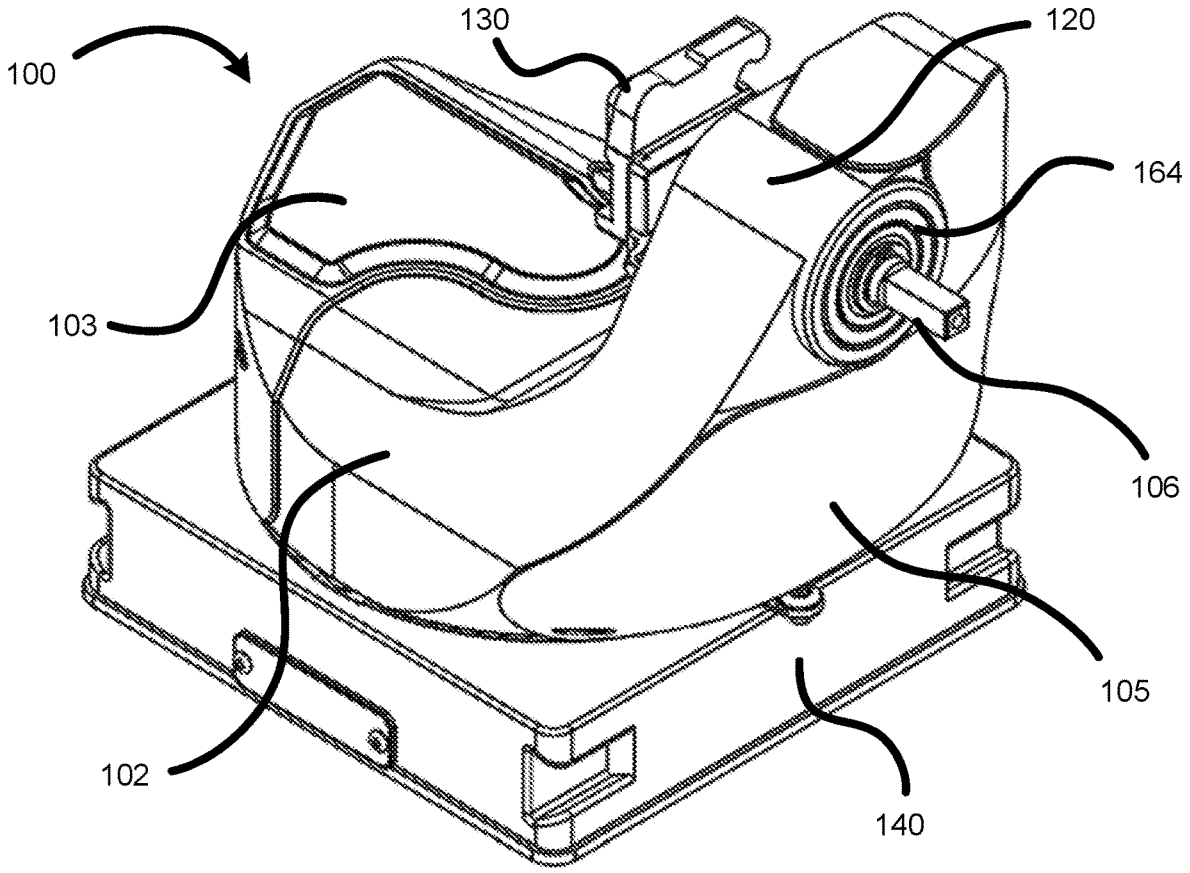
FIG. 1 illustrates a weapon mount that is configured for controlling targeting or aiming of an attached weapon.
Figure 2:
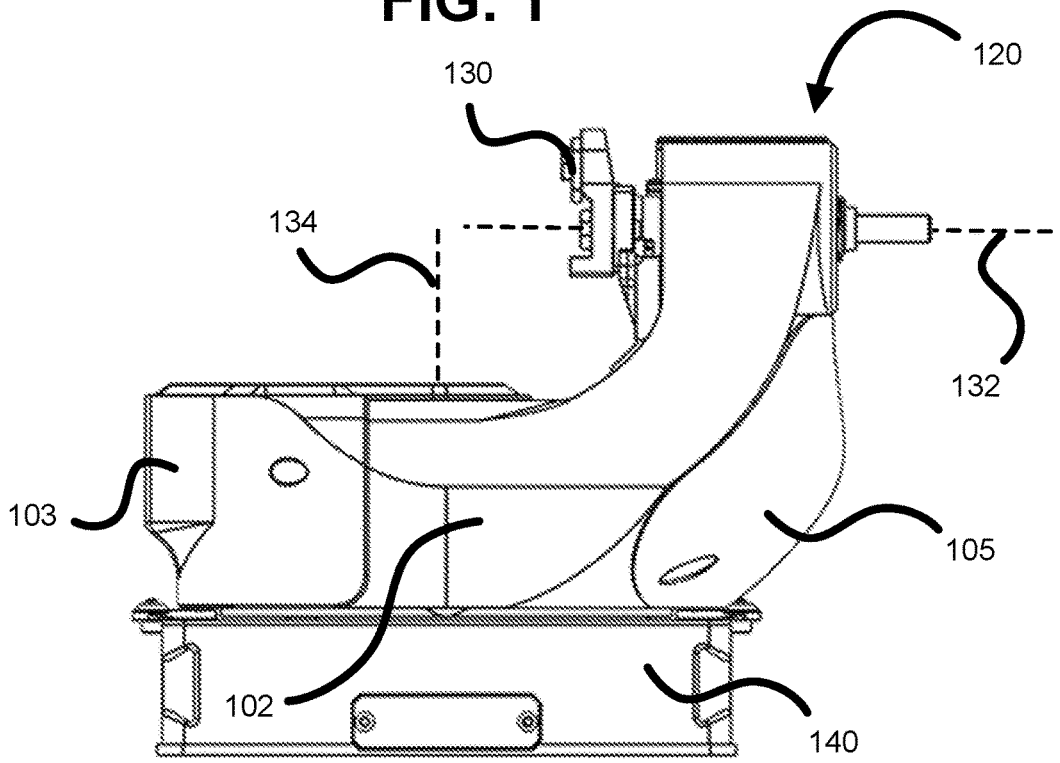
FIG. 2 illustrates a side view of the weapon mount of FIG. 1.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments described herein relate to weapon mounts that are configured to control targeting or aiming of a lethal or non-lethal weapon, such as a military firearm, an electrical based weapon (e.g., Taser), a rubber pellet or bean bag based weapon, and the like. The weapon mount includes a yoke or base that is rotatably attachable to a platform. The platform may in turn be fixedly attached or secured to a vehicle so that the weapon mount and attached weapon may be transported in a geographical area, or the platform may be attached or secured to a stationary object, such as a ceiling, gate, fence, rail, and the like. The vehicle may be a motorized land vehicle (e.g., car, truck, etc.), an aquatic vehicle (e.g., boat, raft, etc.), an aerial vehicle (e.g., plane, drone, helicopter, etc.), and the like. The platform contains or houses various electronics or electrical components, such as a targeting computer or system. The platform provides an interface between those electronics/electrical components and the base. The base is rotatable about the platform to control a yaw of the weapon relative to the platform and the vehicle.

The base includes a two axis positioner or positioning system, which enables the weapon mount to control motion of the weapon in two dimension—i.e., a yaw and pitch of the weapon. The two axis positioner or positioning system typically includes a pair of control systems that each control movement of the weapon in one dimension or direction. Each control system has a motor, motor controller, and/or gear train to control movement of the weapon. The control system or gear train may include a chain drive, one or more spur gear, a direct drive, a harmonic drive, and the like. The control system provides a mechanical advantage that balances torque and speed of the weapon, which enables quick and accurate targeting of the weapon.

The base includes an arm that extends from the base. In some embodiments the weapon mount includes a single arm that extends from the base while in other embodiments, the weapon mount includes two or more arms. The arm is positioned relative to the base so that a recoil vector of the weapon is within 0.5 inches radially of an axis of rotation of the base (e.g., Azimuth axis), which minimizes impact of the weapon's recoil on the weapon mount and attached weapon. An attachment component that is configured to couple the weapon with the base and weapon mount is rotatably coupled with the arm. The attachment component is rotatable to control a pitch of the weapon relative to the platform and the vehicle. In a specific embodiment, the attachment component couples with an upper receiver of the weapon, such as by coupling with a standard picatinny rail or other coupling component. When the weapon is coupled with the attachment component, the lower receiver of the weapon extends outward and away from the arm and is typically roughly parallel with a plane of a top surface of the base.

The weapon mount may also include a camera that is rotatably coupled with the arm. The camera is typically positioned on an opposite side of the arm from the weapon and is configured to rotate in pitch with the weapon. In other embodiments, the camera may be positioned on the same side of the arm as the weapon or may be positioned on a separate arm from the weapon or elsewhere in relation to the weapon mount. The weapon mount also typically includes a processing unit (e.g., one or more processors) that is operably coupled with one or more motors of the weapon mount and/or with the camera. The processing unit is configured to perform one or more of the following processes: controlling the yaw of the weapon via rotation of the base, controlling the pitch of the weapon via rotation of the attachment component, and/or controlling one or more functions of the camera. The camera may be coupled with the arm via a spherical joint that enables adjustment of a position of the camera relative to the arm and relative to the weapon. The spherical joint enables a user to adjust the pitch and roll of the camera relative to the arm and weapon. The arm may include a double bearing that supports an internal drive shaft that is coupled with the attachment component and with the camera.

The weapon mount may weigh less than 15 pounds. Despite this lightweight, the weapon mount is able to control payloads that are dynamic in nature. Specifically, as the weapon is fired, the mass of the weapon changes due to the reduction in ammunition. In addition, the cycling action of the weapon changes an inertia of the payload, as do the recoil vectors from firing the weapon. The weapon mount is able to accurately and precisely control the movement and targeting of the weapon despite these dynamic changes.

Having described several aspects of the weapon mount generally, additional aspects and features of the weapon mount will be readily recognized by reference to the description of the various drawings provided herein below.

Referring to FIG. 1, illustrated is a weapon mount 100 that is capable of, and configured for, controlling a targeting or aiming of an attached weapon. For ease in describing the embodiments herein, the weapon will be described as a firearm 200, although it should be realized that the weapon may be any lethal or non-lethal weapon as desired. The mount 100 is capable of supporting a variety of payloads, including non-lethal or less-than-lethal weapons, such as cameras, surveillance equipment, and the like. As such, while the disclosure herein generally refers to a weapon or firearm being attached or mounted on the mount 100, it should be realized that components other than weapons may be attached to, or mounted on, the mount 100 and used therewith. Accordingly, the term "weapon" or "firearm" as used herein may be replaced in the description or claims with non-lethal weapons or other devices or components, such as cameras, surveillance equipment, Tasers, rubber pellet or bean bag devices, and the like.

The weapon mount 100 may be remotely operated, which enables the targeting or aiming of the firearm 200 to be controlled from a distance. For example, in military applications, an operator may be stationed at a safe distance from a combat zone and identify and engage a target within the combat zone. The weapon mount 100 may be operated and controlled as described in U.S. application Ser. No. 16/181,153, filed Nov. 5, 2019, entitled "Semi-Autonomous Motorized Weapon Systems", the entire disclosure of which is incorporated by reference herein. The weapon mount 100 may weigh between 7 and 11 pounds prior to attachment of the firearm 200. The weight of the weapon mount 100 allows it to be easily transported by a vehicle, including a small drone, between geographic locations. The weapon mount 100 is designed to be extremely durable and an accurate in engaging an identified target.

Figure 4:
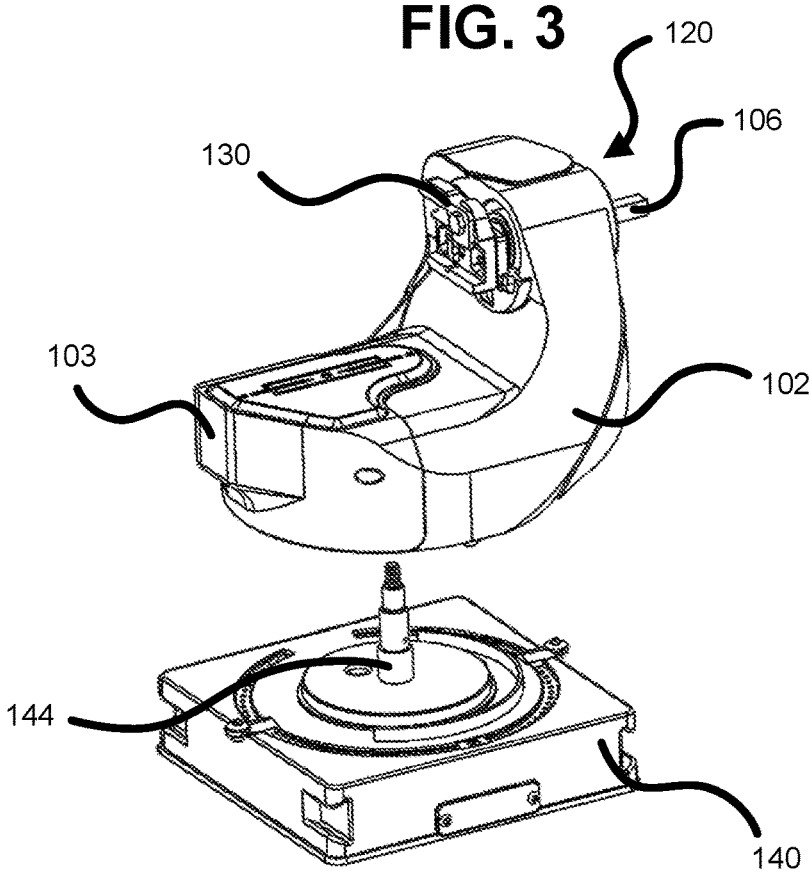
FIG. 4 illustrates a perspective view of the weapon mount of FIG. 1 with a base removed from a platform of the weapon mount.
Figure 5:
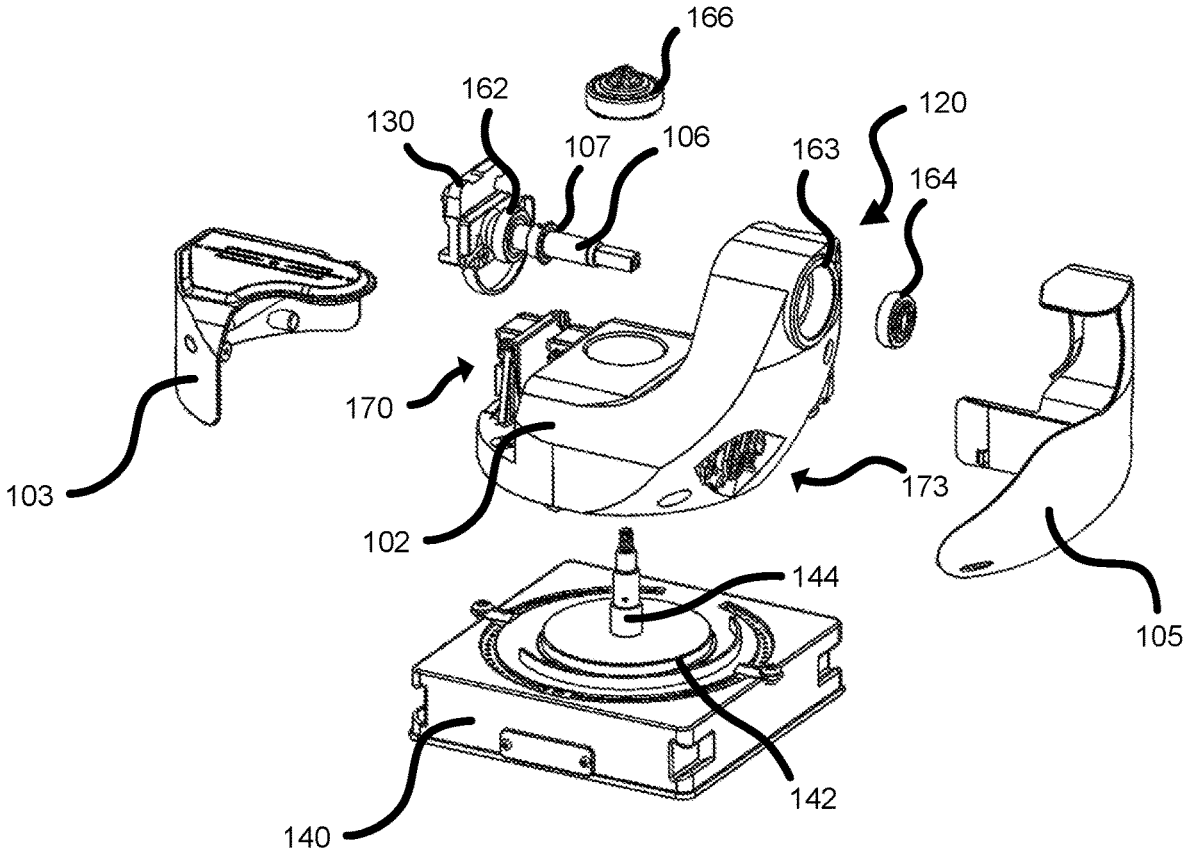
FIG. 5 illustrates a perspective exploded view of several components of the weapon mount of FIG. 1.
Figure 7:
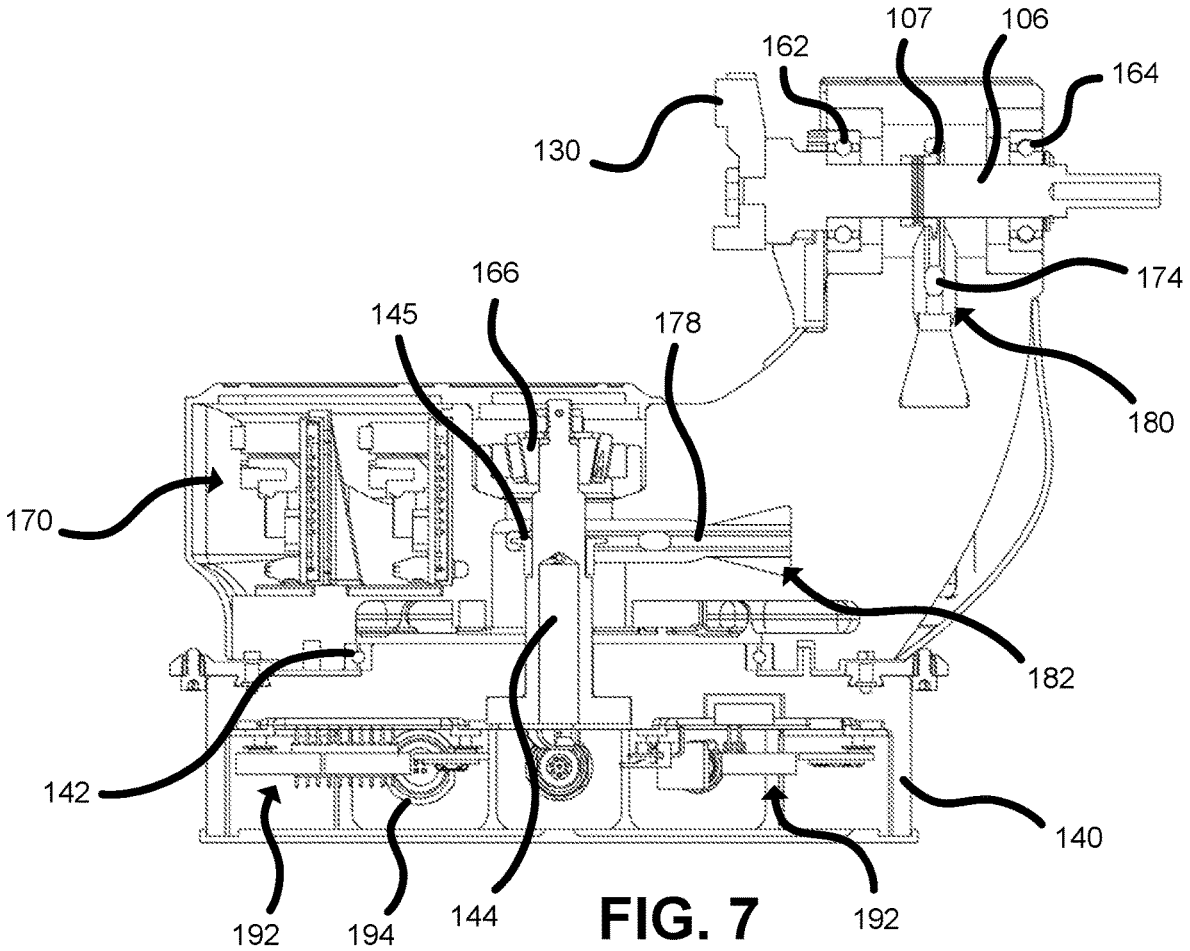
FIG. 7 illustrates a side cross section view of the weapon mount of FIG. 1.

The weapon mount 100 includes a base 102 that is attachable to a platform 140. The base 102 is rotatable by up to 360 degrees about the platform 140, although in some embodiments, stops or ends may be installed that limit the rotation of the base 102 about the platform 140. In a specific embodiment, one or more stops or ends may be employed that limit rotation of the base 102 so that the base 102 is rotatable about the platform by up to 180 degrees. Rotation of the base 102 about the platform 140 enables the weapon mount to control a yaw of the firearm 200 relative to the platform 140 and an attached object, such as a vehicle. As illustrated in FIGS. 4, 5, and 7, the platform 140 includes a cylindrical shaft 144 that is inserted within a central aperture 188 of the base 102 to couple the base 102 with the platform 140. The cylindrical shaft 144 has a square interface that keys or fits into a corresponding aperture or receptacle of the platform 140. The square interface of the cylindrical shaft 144 prevents relative rotation of the cylindrical shaft 144 about the platform 140. A cylindrical boss extends upward from the square interface to accommodate one or more bearings and a drive train that engages with the cylindrical shaft 144 and drives rotation of the base 102 about the platform 140.

The base's central aperture 188 extends upward into a body of the base 102 from a bottom surface of the base 102. The central aperture 188 is shaped and sized to correspond with the cylindrical shaft 144. The base 102 is coupled with the platform 140 by axially aligning the central aperture 188 and the cylindrical shaft 144 and by inserting the cylindrical shaft 144 within the central aperture 188. An upper bearing 166 is attachable to an upper portion of the cylindrical shaft 144 by inserting the upper bearing 166 through an upper surface of the base 102. The upper bearing 166 secures the base 102 to the platform 140. When coupled with the cylindrical shaft 144, the upper bearing 166 contacts an upper portion of the central aperture 188 to guide rotation of the base 102 about the platform 140. The platform 140 also includes a lower bearing 142 that contacts a bottom end or surface of the base 102 to further guide rotation of the base 102 about the platform 140. A diameter of the lower bearing 142 is significantly larger than the upper bearing 166, which stabilizes the base 102 about the platform 140 and minimizes unwanted movement or rotation of the base 102 about the platform 140. Similarly, the upper bearing 166 and lower bearing 142 provide two points of contact between the base 102 and the platform 140 and function cooperatively to stabilize the base 102 about the platform 140, thereby minimizing unwanted movement or rotation of the base 102 about the platform 140.

Figure 8:
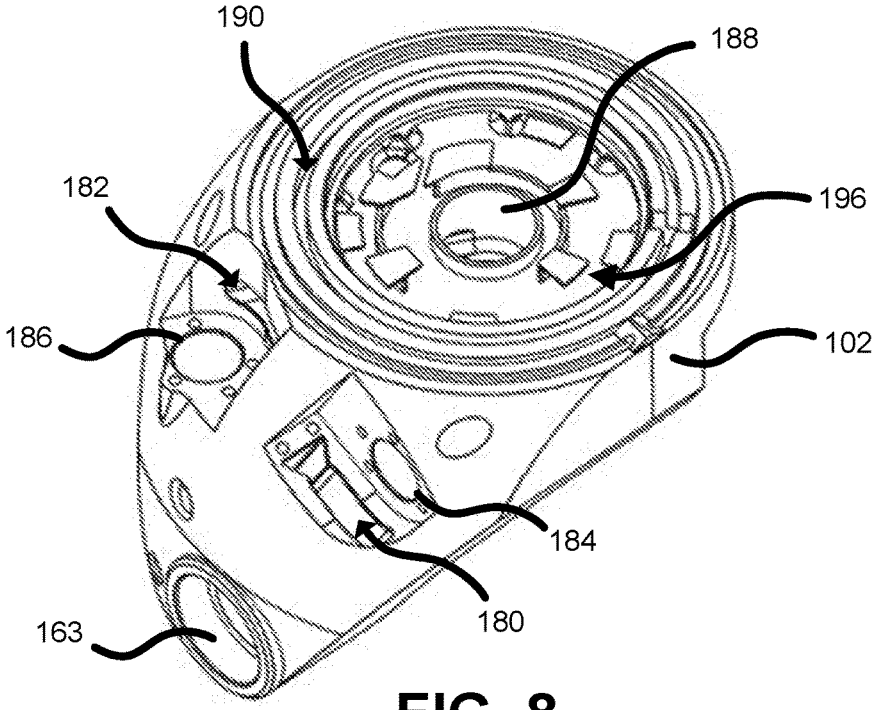
FIG. 8 illustrates a rear perspective view of the weapon mount of FIG. 1 with an outer cover of the base removed from view.

In some instances, an annular rib or fin of the platform 140 in inserted within an annular channel 190 (see FIG. 8) on the bottom surface of the base 102. Insertion of the annular rib within the annular channel 190 minimizes penetration of debris or fluids between the base 102 and platform 140 and may aid in stabilizing the base 102 about the platform 140.

The weapon mount 100 also includes a yoke arm 120 that extends upward from the base 102. The weapon mount 100 typically includes a single yoke arm 120, as illustrated in the drawings, but in some instances the weapon mount 100 may include multiple yoke arms. The yoke arm 120 is coupled with the base 102 so that the yoke arm 120 extends upward and outward to a degree from one side of the base 102. The geometry of the base 102 and yoke arm 120 is designed to balance the mass of various components (e.g., the firearm and camera) attached to the yoke arm 120, and to accommodate a change in mass of the firearm 200, which may be due to a difference in the attached weapon (e.g., different weapon attached to picatinny rail), difference in bullet or load that is fired, difference due to discharge of rounds, and the like.

The geometry of the base 102 and yoke arm 120 is also able to accommodate bolt cycling and a recoil vector and direction of the firearm 200 while minimizing load transfer into the platform 140. In regards to the recoil vector and direction, the position and shape of the yoke arm 120 in relation to the base 102 is configured to ensure that the recoil impulse or force from the projectile is aligned over the pivot point of the base 102. More specifically, the yoke arm 120 is positioned relative to the base 102 so that a recoil vector of the attached firearm 200 is within ½ inch radially of an axis 134 of rotation of the base 102, which helps minimize the torque generated about the axis 134 due to recoil of the firearm 200.

Since the firearm's recoil vector is positioned within ½ inch of the base's rotational axis 134, the yoke arm 120 experiences very minimal, or essentially negligible, rotational torque due to firing of the firearm 200. Rather, the only substantial forces or loads that are imparted on the yoke arm 120 due to firing of the firearm 200 is a backward or rearward force or strain on the yoke arm 120. As such, the weapon mount 100 is able to maintain exceptional aiming or targeting on an identified target as the firearm 200 is continuously fired. The configuration of the yoke arm 120 and base 102 are able to account for firearms of different shape and size. The yoke arm 120 and base 102 are also able to account for different firearm components, such as varying picatinny rail thicknesses. The configuration of the yoke arm 120 and base 102 ensures that the recoil vector for essentially any attached firearm 200 is within ½ to 1 inch of the pivot point of the base 102. In some embodiments, a compensating component (not shown), such as a spacer, may be employed between the attachment component 130 and firearm 200 to account for slight variation in dimensions of the firearm.

Figure 9:
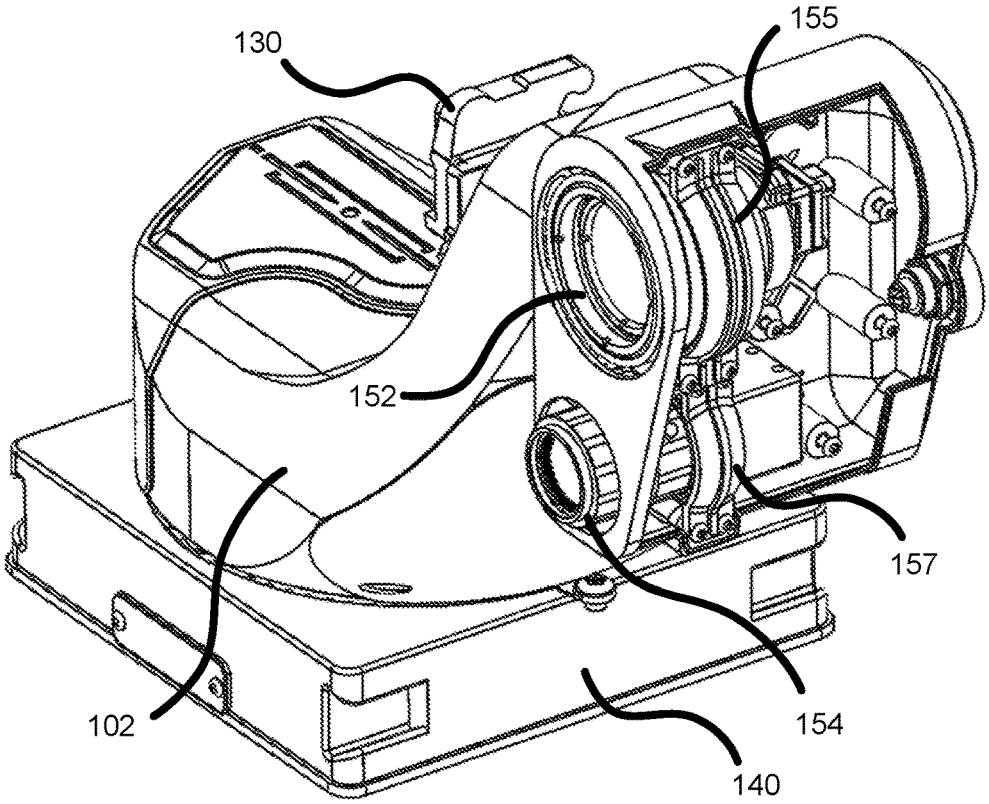
FIG. 9 illustrates a perspective view of the weapon mount of FIG. 1 with a side panel of a camera housing removed to show internal components of the camera housing.

As illustrated in FIGS. 1 and 9, a base or bottom portion of the yoke arm 120 is relatively large. In addition, essentially all transitions between or within the base 102 and yoke arm 120 are radiused, which enables the yoke arm 120 to be able to handle the forces and loads that are imparted on the yoke arm 120 as the firearm 200 is fired. Specifically, a width and thickness of the yoke arm's base is larger than an upper portion of the yoke arm 120. The yoke arm 120 tapers between the yoke arm's base and the yoke arm's upper portion, which enables the yoke arm to handle all imparted forces from the firearm 200, such as rotational moments that are induced on the yoke arm 120 and base from firing of the firearm 200.

The base 102 is also relatively large, which enables the base 102 to absorb the forces or loads induced from firing the firearm 200. The relatively large base 102 enables the base to withstand rotational forces exerted on the base 102 from the yoke arm 120. The configuration of the base 102 and yoke arm 120 maximizes load transfer and stiffness while reducing the overall weight of the weapon mount 100. For example, the large base 102, and relatively large yoke arm base, allows wall thicknesses of the base 102 and yoke arm 120 to be reduced, which increases the size of a cavity within the yoke arm 120 and base 102. The increased cavity size allows for larger components or additional components to be positioned within the base 102 and yoke arm 120, such as the weapon mount's drive train.

The yoke arm 120 includes an attachment component 130 that is configured for releasably attaching the firearm 200 to the base 102. The attachment component 130 is rotatable about an axis 132 that is orthogonal to the rotational axis 134 of the base 102, which enables the firearm 200 to be rotated between 30 and 60 degrees relative to the yoke arm 120. The firearm 200 is typically rotatable ±30 degrees about axis 132 relative to a horizontal plane. The attachment component 130 is rotatable about the yoke arm 120 to control a pitch of the firearm 200 relative to the base 102, platform 140, and an object to which the platform is attached. In some embodiments, the attachment component is configured to couple with a mounting feature of the firearm 200, such as a picatinny rail 202 (see FIG. 12). The attachment component 130 is able to secure the firearm 200 to the weapon mount 100 while enabling easy release of the firearm 200, such as for replacement with a different weapon or firearm.

Figure 12:
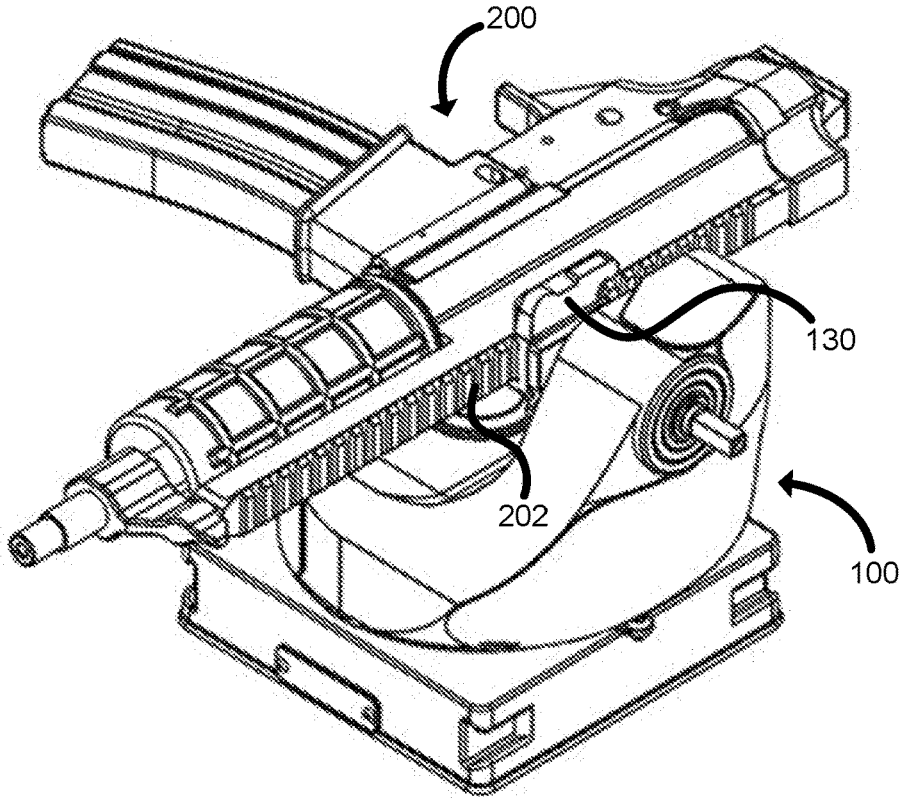
FIG. 12 illustrates a perspective view of the weapon mount of FIG. 1 with a weapon attached to the weapon mount.

As illustrated in FIG. 12, the attachment component 130 is configured to couple with the firearm 200 so that the attached firearm 200 is aligned roughly parallel with a plane of the base 102. Specifically, an upper receiver of the firearm 200 is attached to the attachment component so that a lower receiver of the firearm 200 is roughly aligned with a plane of a top or bottom surface of the base 102. In most instances, the firearm 200 is attached to the weapon mount 100 so that the lower receiver of the firearm 200 is positioned horizontally atop the base 102 and/or is positioned roughly orthogonally relative to the yoke arm 120. Positioning the firearm 200 roughly parallel with the base 102 reduces an overall height of the weapon mount 100 since the yoke arm does not need to account for the size and/or shape of the firearm and an attached magazine. The weapon mount 100 is configured to interface with any Picatinny accessory rail that conforms to MIL-STD-1913. The horizontal positioning of the firearm 200 allows easy access to the firearm's magazine, which allows the magazine to be quickly installed and removed from the firearm 200 as needed. The roughly parallel positioning of the firearm 200 also allows the casings to be ejected downward and toward the base 102 or upward and away from the base as desired, which reduces or eliminates undesired striking of surrounding objects (e.g., the yoke arm 120 or vehicle) by the discharged casings. This outward ejection of the casings further reduces or eliminates issues associated with a casing contacting another object that would prevent a proper ejection of the casing and possible jamming of the weapon.

Figure 6:
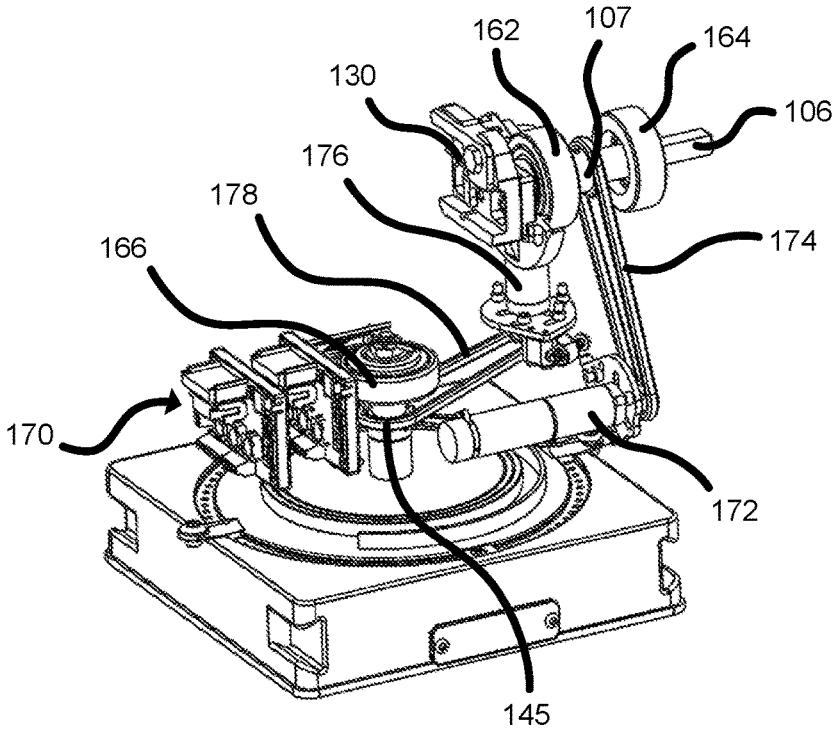
FIG. 6 illustrates a perspective assembled view of the weapon mount of FIG. 1 with a housing of the base removed so that several internal components are visible.

As illustrated in FIGS. 5-7, the attachment component 130 is coupled with a drive shaft 106 that is positioned through an aperture or channel 163 on the upper end of the yoke arm 120. The attachment component 130 is coupled with the drive shaft 106 so that the attachment component 130 is positioned on an inner side of the yoke arm 120 above the base 102. The drive shaft 106 is rotatably supported within the yoke arm's aperture 163 by a pair of bearings, and more specifically an inner bearing 162 and an outer bearing 164. The inner bearing 162 is positioned adjacent the inner side of the yoke arm 120 while the outer bearing 164 is positioned adjacent the outer side of the yoke arm 120. This double bearing design distributes any load that is imparted on the yoke arm 120 by the attached firearm 200. The two points of rotational contact stabilize the drive shaft 106 within the channel 163 and stabilize the attached firearm 200 about the weapon mount 100. In some embodiments, the drive shaft 106 may be a direct drive system that directly controls rotation of the attachment component 130. The direct drive system may using gearing, a harmonic drive, and the like to provide a desired mechanical advantage that balances the speed and torque of the attached firearm 200.

Figure 3:
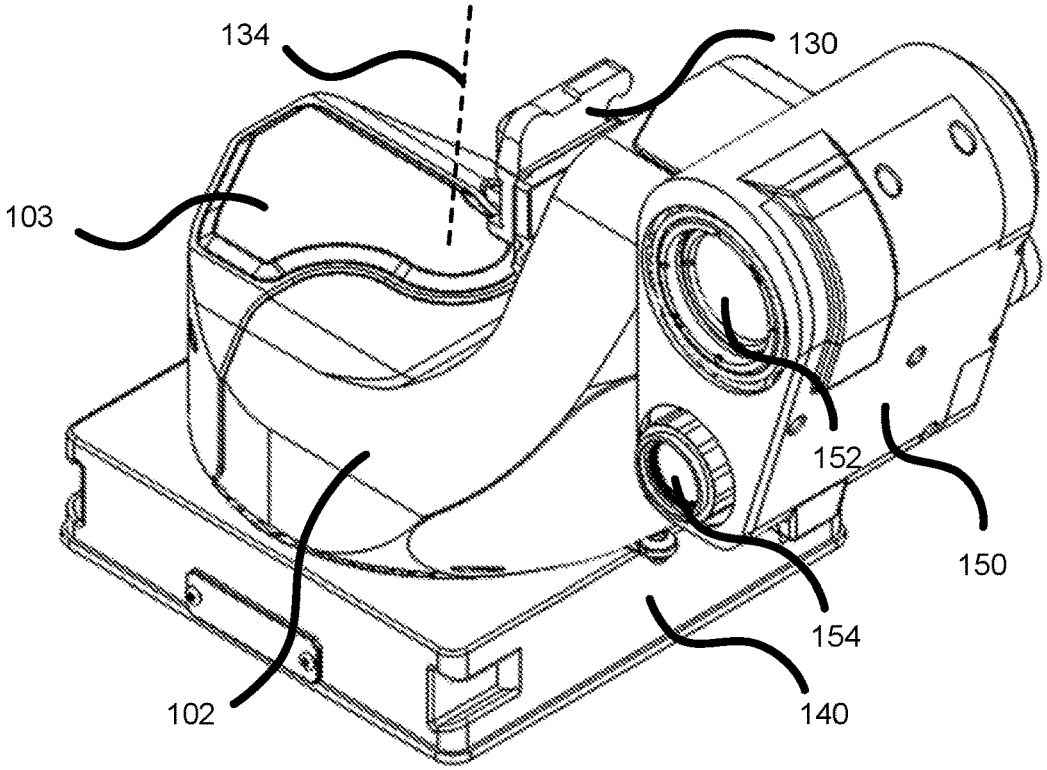
FIG. 3 illustrates a perspective view of the weapon mount of FIG. 1 with a camera attached to a side of the weapon mount.

Referring to FIG. 3, the weapon mount 100 typically includes a camera housing 150 that is coupled with the yoke arm 120. The camera housing 150 includes a camera, which may be an infrared camera or any other camera that is required/desired based on an operational environment and/or usage of the weapon mount 100. For example, the camera housing 150 may house a Long Wave Infrared (LWIR) camera 152 and a visible camera 154. A combination of these cameras may enable the weapon mount 100 to be used in a variety of conditions, although other cameras, or additional cameras, may be selected based on operational requirements. The camera housing 150 is typically positioned on an exterior side of the yoke arm 120 opposite the attached firearm 200. The design of the camera housing 150, and specifically the shape of the camera housing and the side positioning of the yoke arm 120, helps balance the mass of the firearm 200 that is attached on the opposite side of the yoke arm 120. The camera housing 150 is rotatable about an axis that is parallel to the rotational axis 132 of attachment component 130. The camera housing 150 is configured to rotate in sync with the attached firearm 200 so that a center of viewpoint of the camera is roughly aligned with a bore axis of the attached firearm 200. In this manner, the camera housing 150 and the attached firearm 200 are able to rotate together in pitch, which ensures that the field of view of an operator of the firearm 200 corresponds to the field of view of the firearm 200.

Figure 10:
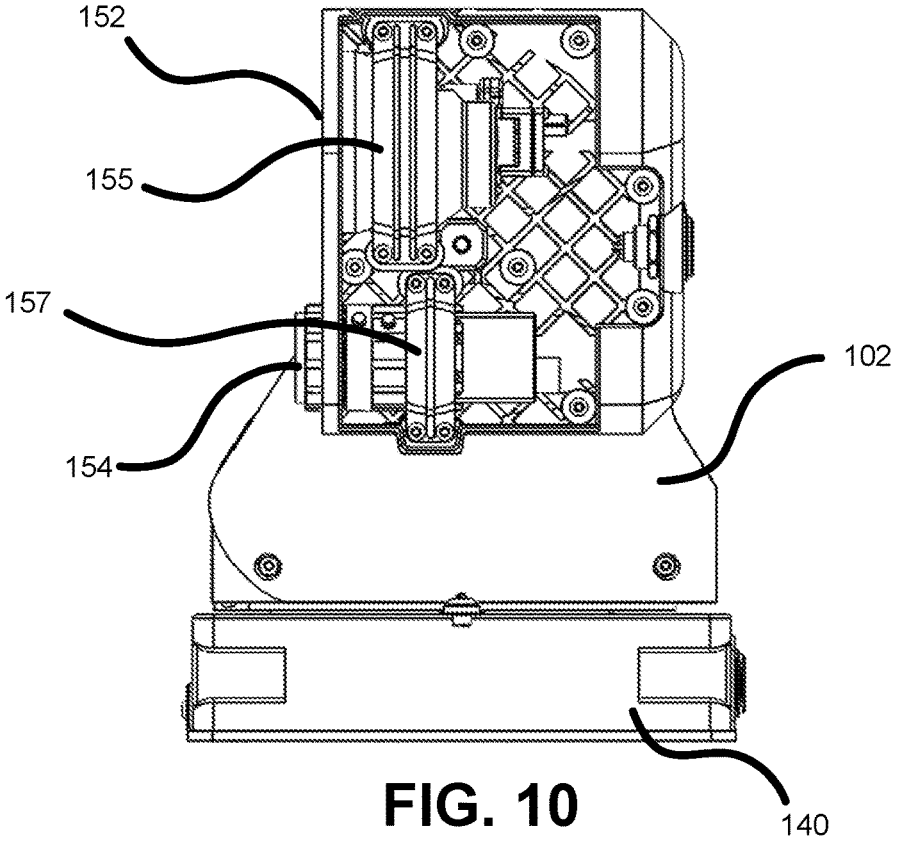
FIG. 10 illustrates a side view of the weapon mount of FIG. 1 with the side panel of the camera housing removed.
Figure 11:
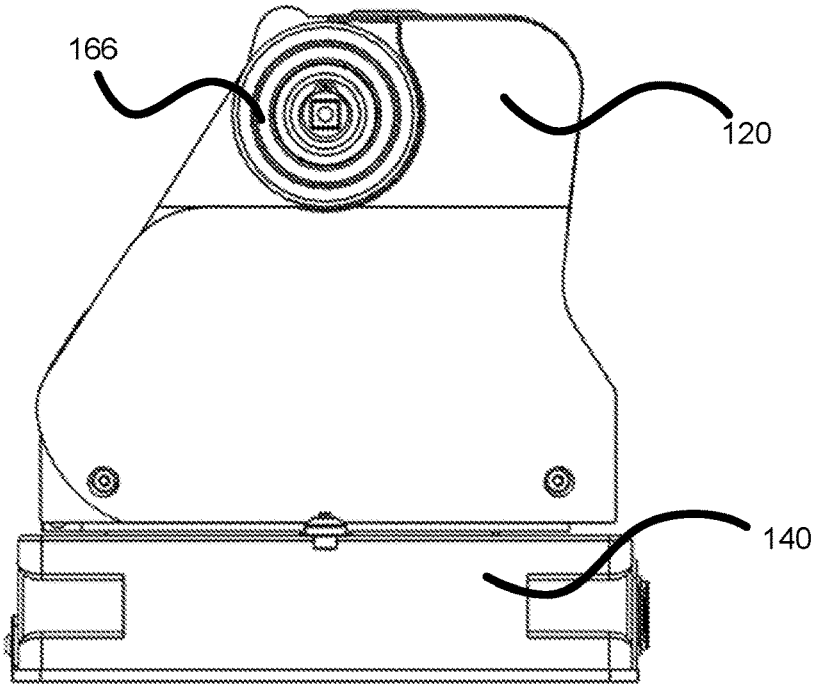
FIG. 11 illustrates a side view of the weapon mount of FIG. 1 with the camera housing removed.

In some embodiments, the camera's rotational axis is coaxial with the rotational axis 132 of the attachment component 130. This design may be achieved by coupling the camera housing 150 with an end of the drive shaft 106 that extends from the exterior side of the yoke arm 120. The cameras, 152 and 154, may be coupled with the camera housing 150 via a spherical joint that enables adjustment of a position of the cameras, 152 and 154, relative to the camera housing 150. FIGS. 9-10 illustrate the spherical joints that couple the cameras, 152 and 154, with the camera housing 150. In FIGS. 9-10, a side panel of the camera housing 150 is removed so that the internal components are visible. A first spherical joint 155, or spherical clamp interface, couples the camera 152 with the camera housing 150 while a second spherical joint 157, or spherical clamp interface, couples the camera 154 with the camera housing 150. The spherical joints, 155 and 157, allow the cameras, 152 and 154, to be easily adjusted within, and relative to, the camera housing 150, and also allow the cameras, 152 and 154, to be removed from the camera housing 150 for inspection, repair, replacement, or upgrade. Adjustment of the cameras, 152 and 154, via the spherical joints, 155 and 157, ensures a proper alignment of the cameras within the camera housing 150 and relative to the attached firearm 200.

In some embodiments, the base 102 and/or platform 140 include a processing unit that is configured to control a rotation of the base 102, control a rotation of the attachment component 130, and/or control one or more functions of the camera. The processing unit is used to control the yaw and pitch of the attached firearm 200 and camera housing 150. As illustrated in FIGS. 5-7, the base 102 may include one or more electrical components 170, such as one or more processors, memory units, communication components, and the like, that are housed within an inner cavity of the base 102 and that are accessible via a removable cover 103. Similarly, the platform 140 may include one or more electrical components 192, such as one or more processors, memory units, communication components, and the like, that are housed within an inner cavity of the platform 140. The electrical component(s) 170 of the base 102 may be communicatively coupled with the electrical component(s) of the platform 140 via a coiled electrical contact (not shown) that is disposed within the bottom surface of the base 102. The base 102 is designed to retain and guide the coiled electrical contact in a controlled manner as the base 102 is rotated about the platform 140. Specifically, the base includes a plurality of retaining tabs or axially extending legs 196 (see FIG. 8) that are designed to retain and guide the coiled electrical contacts in a controlled manner as the base 102 is rotated about and atop the platform 140. Rotation of the base 102 about axis 134 causes the electrical contact coil to expand and contract, similar to a clock spring. The retaining tabs 196 extends radially outward and beyond the coiled electrical contact to maintain the coiled electrical contact within a channel that extends circumferentially around the central aperture 188. The platform 140 may also include one or more electrical ports 194 that allow the weapon mount 100 to be communicatively coupled with one or more external electrical components, processors, and/or logic units.

The electrical component(s) of the base 102 and/or platform 140 may be any electrical component that is desired or required for an operational use or objective of the weapon mount. The electrical component(s) may include memory devices, wired or wireless communication devices, sensors, graphical processing units, processors, and the like. The electrical components of the base 102 and platform 140 may perform some portion or all of the processes required to perform a desired function. Some or all of the instructions for performing a function may be stored locally within one or more memory devices housed within the base 102 or platform 140, or such instructions may be stored remotely and wirelessly transmitted to the weapon mount 100 via a wireless communication component. Artificial intelligence, or a logic unit, may be employed in performing one or more functions or desired tasks. Exemplary embodiments of the operation and control of the weapon mount are further described in the '153 Application, which is incorporated by reference herein. In a specific embodiment, the processing units and/or software may account for the sight over bore and/or the left or right positioning of the camera in relation to the bore axis of the attached firearm 200.

As illustrated in FIGS. 6 and 7, the weapon mount 100 includes a two axis positioner, or positioning system, that enables the position of the firearm to be precisely controlled about two axes. The two axis positioning system may include a motorized system that drives rotation of the base 102 and attachment component 130. The motorized system typically includes a gear train that operably couples the motor with the base 102 and attachment component 130. The gear train may be designed to provide a predetermined mechanical advantage that balances torque and speed of the weapon attached to the attachment component 130. A precise mechanical advantage from the appropriately designed gear train enables the weapon mount to have the ability to precisely control positioning of any weapon, lethal or non-lethal, that is attached to the attachment component 130. In other embodiments, the gear train may be eliminated in favor of a direct drive system.

As illustrated in FIGS. 6 and 7, the motorized system may be an integrated motorized system 173 that drives rotation of the base 102 and that drives rotation of the attachment component 130. Specifically, as illustrated in FIG. 6, the base includes a first integrated motor 176 that is operably coupled with the cylindrical shaft 144 to drive rotation of the base 102 relative to the platform 140. The yoke arm 120 similarly includes an integrated motor 172 that is operably coupled with the drive shaft 106 to drive rotation of the attachment component 130 and the attached components about the yoke arm 120. The integrated motors, 172 and 176, may be controlled via the electrical component(s) 170 of the base 102 and/or via the electrical component(s) of the platform 140. The base 102 is designed so that the motors and any necessary components or provisions are housed or integrated within the base 102. The configuration of the motors and corresponding components within the base 102 and yoke arm 120 enables the height of the weapon mount 100 to be greatly reduced.

As illustrated, a main body of the integrated motor 176 is positioned within the yoke arm 120. The integrated motor 176 is positioned within the yoke arm 120 so that the output shaft and an attached sprocket are positioned downward within the base 102. A housing aperture 186 within the yoke arm 120 for the integrated motor 176 is visible in FIG. 8 due to a cover 105 of the yoke arm 120 being removed from view in FIG. 8. The yoke arm's cover 105 conceals and protects the integrated motors, 172 and 176, during operation of the weapon mount 100, but may be easily removed to access one or both of the integrated motors, 172 and 176. The integrated motor 176 may be attached to the yoke arm 120 via one or more mechanical fasteners or via any other means known in the art. The integrated motor 176 is fixedly secured within the housing aperture 186 to minimize or eliminate relative movement of the integrated motor 176 about the yoke arm 120.

The integrated motor 176 is operably coupled with the cylindrical shaft 144 via a drive belt, cable, or chain 178 that extends between the integrated motor's output shaft and a sprocket 145 that is fixedly attached to the cylindrical shaft 144. A channel 182 that extends horizontally within the base 102 for the drive belt 178 between the integrated motor 176 and cylindrical shaft 144 is visible in FIGS. 7 and 8. The integrated motor system may be geared so that a desired mechanical advantage is achieved and so that a desired rotation of the base 102 is achieved in response to operation of the integrated motor 176.

Similarly, a main body of the integrated motor 172 is positioned horizontally within the base 102 so that the output shaft and an attached sprocket are positioned within the yoke arm 120. A housing aperture 184 within the base 102 for the integrated motor 172 is visible in FIG. 8 due to removal of the yoke arm's cover 105. The integrated motor 172 may be attached to the base 102 via one or more mechanical fastener or via any other means known in the art. The integrated motor 172 is fixedly secured within the housing aperture 184 to minimize or eliminate relative movement of the integrated motor 172 about the base 102. The integrated motor 172 is operably coupled with the drive shaft 106 via a drive belt, cable, or chain 174 that extends between the integrated motor's output shaft and a sprocket 107 that is fixedly attached to the drive shaft 106 between the inner bearing 162 and the outer bearing 164. A channel 180 that extends upward within the yoke arm 120 for the drive belt 178 between the integrated motor 172 and the drive shaft 106 is visible in FIGS. 7 and 8. The integrated motor system may be geared so that a desired mechanical advantage is achieved and so that a desired rotation of the drive shaft 106 is achieved in response to operation of the integrated motor 172.

The base 102 and/or platform 140 may include one or more power sources, such as batteries (not shown) that are housed within the base 102 and/or platform 140. The power sources may be electrically coupled with the integrated motors, 172 and 176, and/or with the electrical components, 170 and 192, to electrically power the motors and/or components. The base 102 and/or platform 140 may include various other wires or components that are required to achieve a desired operation and function of the weapon mount.

Figure 13:
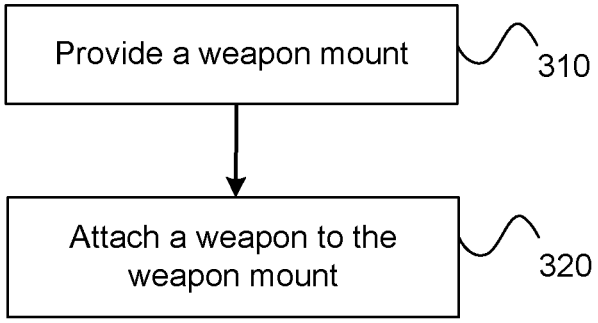
FIG. 13 illustrates a method of attaching a weapon or firearm to a weapon mount.

Referring now to FIG. 13, illustrated is a method of attaching a weapon or firearm to a weapon mount. At block 310 a weapon mount is provided. The weapon mount includes a base, an arm that extends from the base, and an attachment component that is rotatably coupled with the arm. The base is attachable to a platform and is rotatable to control a yaw of the weapon relative to the platform. The attachment component is configured to couple with the weapon and is rotatable to control a pitch of the weapon relative to the platform. The arm is typically positioned relative to the base so that a recoil vector of the weapon is within 0.5 inches radially of an axis of rotation of the base. At block 320, the weapon is attached to the weapon mount. Attaching the weapon or firearm to the weapon mount may include attaching an upper receiver of the weapon or firearm to the weapon mount so that a lower receiver of the weapon extends outward and away from an arm of the weapon mount. The method may also include a camera to the weapon mount.

Figure 14:
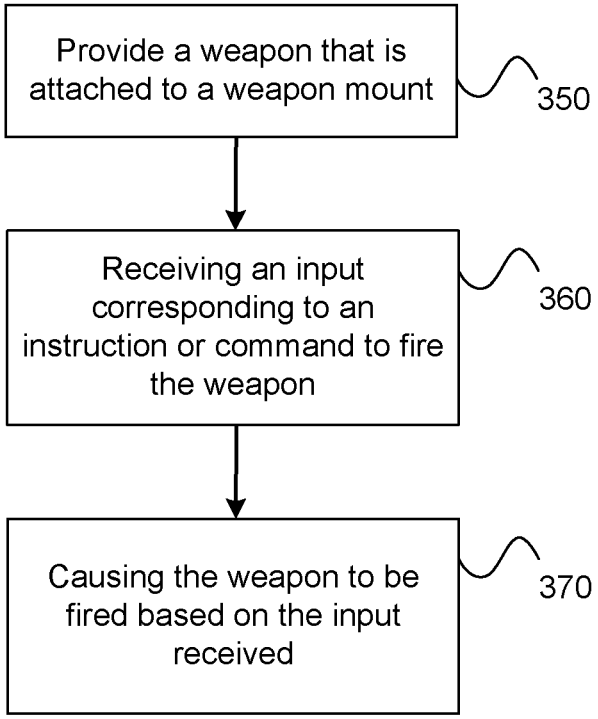
FIG. 14 illustrates a method of remotely firing a weapon.

Referring now to FIG. 14, illustrated is a method of remotely firing a weapon. At block 350, a weapon that is attached to a weapon mount is provided. As described herein, the weapon mount includes a base that is rotatably attachable to a platform, an arm that extends from the base, and an attachment component that is rotatably coupled with the arm. The base is rotatable to control a yaw of the weapon relative to the platform and the attachment component is rotatable to control a pitch of the weapon relative to the platform. The attachment component is coupleable with the weapon. The arm is positioned relative to the base so that a recoil vector of the weapon is within 0.5 inches radially of an axis of rotation of the base. The weapon mount also includes one or more processors and one or more communication components. At block 360, an input corresponding to an instruction or command to fire the weapon is received at the weapon mount via the one or more communication components. At block 370, firing of the weapon is caused, effected or actuated, via the one or more processors, based on the input received.

The one or more communication components may include or consist of a wireless interface or component that is configured to receive and transmit information wirelessly. The weapon mount may be attached to one of the following vehicles: a watercraft, a land vehicle, an armored vehicle, an aircraft, an unmanned aerial vehicle, and the like.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention. It is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A remotely operable weapon mount that is configured for controlling targeting of an attached firearm, the weapon mount comprising:

a base that is attachable to a platform, the base being rotatable 360 degrees about the platform;

a yoke arm that extends from the base;

an attachment component that is coupled with the yoke arm and that is configured for releasably attaching the firearm to the base, the attachment component being rotatable about an axis that is orthogonal to an axis of rotation of the base so the attached firearm is rotatable between 30 and 60 degrees relative to the yoke arm; wherein:

the attachment component is configured to couple with an upper receiver of the firearm so that a lower receiver of the attached firearm is aligned roughly parallel with the base;

the yoke arm is positioned relative to the base so that a recoil vector of the attached firearm is within 0.5 inches radially of the axis of rotation of the base; and the yoke arm includes double bearings that support an internal drive shaft that is attached to the attachment component.

2. The weapon mount of claim 1, further comprising a camera that is coupled with the yoke arm on an opposite side of the yoke arm from the attached firearm, wherein the camera is rotatable about an axis that is parallel to the axis of rotation of the attachment component and wherein the camera is configured to rotate in sync with the attached firearm.

3. The weapon mount of claim 2, further comprising one or more processors that are operably coupled with a motor of the base and with a motor of the yoke arm and that are further operably coupled with the camera in order to:

control the rotation of the base;

control the rotation of the attachment component; and control one or more functions of the camera.

4. The weapon mount of claim 2, wherein the camera is coupled with the yoke arm so that a center of viewpoint of the camera is aligned with a bore axis of the attached firearm and so that the camera and attached firearm rotate together in pitch.

5. The weapon mount of claim 2, wherein the camera is coupled with the yoke arm via a spherical joint that enables adjustment of a position of the camera relative to the yoke arm and attached firearm.

6. The weapon mount of claim 1, wherein the yoke arm includes an integrated motor that controls a rotation of the attachment component.

7. The weapon mount of claim 1, wherein the attachment component is coupleable with the firearm so that casings ejected from the attached firearm are ejected away from or toward the base.

8. The weapon mount of claim 1, wherein the weapon mount includes a single yoke arm.

9. A weapon mount that is configured for controlling targeting of a weapon, the weapon mount comprising:

a base that is rotatably attachable to a platform, the base being rotatable to control a yaw of the weapon relative to the platform;

an arm that extends from the base; and an attachment component that is rotatably coupled with the arm and that is configured to couple with the weapon so that the weapon is operably coupled with the arm, the attachment component being rotatable to control a pitch of the weapon relative to the platform; wherein:

the arm is positioned relative to the base so that a recoil vector of the weapon is within 0.5 inches radially of an axis of rotation of the base; and the arm is the only arm that extends from the base and is operably coupled with the weapon.

10. The weapon mount of claim 9, wherein the attachment component is coupleable with an upper receiver of the weapon such that a lower receiver of the weapon extends outward and away from the arm.

11. The weapon mount of claim 9, further comprising a camera that is rotatably coupled with the arm on an opposite side of the arm from the weapon, the camera being configured to rotate in pitch with the weapon.

12. The weapon mount of claim 11, further comprising one or more processors that are operably coupled with one or more motors of the weapon mount and with the camera, the one or more processors being configured to:

control the yaw of the weapon via rotation of the base;

control the pitch of the weapon via rotation of the attachment component; and control one or more functions of the camera.

13. The weapon mount of claim 11, wherein the camera is coupled with the arm via a spherical joint that enables adjustment of a position of the camera relative to the arm and relative to the weapon.

14. The weapon mount of claim 11, wherein the arm includes double bearings that support an internal drive shaft that is coupled with the attachment component and with the camera.

15. A method of attaching a weapon to a weapon mount, the method comprising:

providing a weapon mount comprising:

a base that is rotatably attachable to a platform, the base being rotatable to control a yaw of the weapon relative to the platform;

an arm that extends from the base; and an attachment component that is rotatably coupled with the arm and that is configured to couple with the weapon so that the weapon is operably coupled with the arm, the attachment component being rotatable to control a pitch of the weapon relative to the platform; and attaching the weapon to the weapon mount;

wherein the arm is positioned relative to the base so that a recoil vector of the weapon is within 0.5 inches radially of an axis of rotation of the base; and wherein the arm is the only arm that extends from the base and is operably coupled with the weapon.

16. The method of claim 15, wherein attaching the weapon to the weapon mount comprises attaching an upper receiver of the weapon to the weapon mount so that a lower receiver of the weapon extends outward and away from the arm of the weapon mount.

17. The method of claim 15, further comprising attaching a camera to the weapon mount.

18. A method of remotely firing a weapon, the method comprising:

providing a weapon that is attached to a weapon mount, the weapon mount comprising:

a base that is rotatably attachable to a platform, the base being rotatable to control a yaw of the weapon relative to the platform;

an arm that extends from the base, wherein the arm is positioned relative to the base so that a recoil vector of the weapon is within 0.5 inches radially of an axis of rotation of the base and wherein the arm includes double bearings;

an attachment component that is rotatably coupled with the arm via an internal drive shaft that is supported by the double bearings of the arm, the attachment component being configured to couple with the weapon and, being rotatable to control a pitch of the weapon relative to the platform;

one or more processors; and one or more communication components;

receiving, via the one or more communication components, an input corresponding to an instruction or command to fire the weapon; and causing, via the one or more processors, firing of the weapon based on the input received.

19. The method of claim 18, wherein the one or more communication components comprise a wireless interface or component that is configured to receive and transmit information wirelessly.

20. The method of claim 18, wherein the weapon mount is attached to one of the following vehicles:

a watercraft;

a land vehicle;

an armored vehicle;

an aircraft; or an unmanned aerial vehicle.

* * * * *